United States Patent [19]

Johnson et al.

[11] Patent Number: 4,691,606

[45] Date of Patent: Sep. 8, 1987

[54] WEB PERFORATING APPARATUS

[75] Inventors: Roy A. Johnson, Marietta, Ga.; Robert H. Ganz, Saddle River, N.J.

[73] Assignee: The Mead Corporation, Dayton, Ohio

[21] Appl. No.: 891,646

[22] Filed: Aug. 1, 1986

[51] Int. Cl.[4] ..... B26D 7/14; B26D 1/62; B26F 1/20

[52] U.S. Cl. ..... 83/175; 83/343; 83/346; 83/660

[58] Field of Search ..... 83/175, 343, 346, 660

[56] References Cited

U.S. PATENT DOCUMENTS

| | | | |
|---|---|---|---|
| 3,550,826 | 12/1970 | Salmela | 33/660 X |
| 3,565,308 | 2/1971 | Slack | 83/660 X |
| 3,902,954 | 9/1975 | Lotto | 83/175 X |

*Primary Examiner*—Donald R. Schran

*Attorney, Agent, or Firm*—Rodgers & Rodgers

[57] ABSTRACT

As a conditioning step for wrapping a plurality of articles in a low density polyethylene shrink film, perforations are formed in the shrink film for receiving machine elements utilized in performing the wrapping operation, the film being moved continuously between a pair of infeed rolls and a pair of outfeed rolls between which a rotatable mandrel is disposed and which includes perforating knives thereon for engaging the film while the film is moved continuously, the perforating knives being disposed on the opposite side of the web from a rotatable back up roll having cavities formed therein for receiving the ends of the perforating knives in such manner that the web is maintained under tension throughout the perforating process while the backup roll serves to prevent sidewise movement of the web due to web perforating action of the perforating knives.

9 Claims, 14 Drawing Figures

WEB PERFORATING APPARATUS

TECHNICAL FIELD

This invention relates to the packaging of a plurality of items within a shrink film of low density polyethylene material and is concerned with the formation of perforations in the film at spaced intervals therealong for receiving machine elements in the perforations which elements perform package wrapping operations.

BACKGROUND ART

Appartus for wrapping a plurality of containers in a wrapper formed of shrink film are known in which the film is wrapped about the longitudinal axis of the package group. In many such devices, a wrapper is wrapped about a package group while the group is moved in the direction of its longitudinal axis. Certain manipulative problems have been encountered when a film is wrapped about the axis of a package group in instances in which the longitudinal axis of the package group is disposed in the direction of movement of the package group.

DISCLOSURE OF THE INVENTION

According to this invention in one form, a continuously moving flexible web of shrink film material is perforated at spaced intervals so as to provide openings for receiving machine elements which effect wrapping about the axis of the article group which is transverse to the direction of movement of the articles. Such perforations are formed by at least one knife fixedly mounted on a rotatable mandrel which engages the film while the web is under tension due to the action of infeed and outfeed rolls. The film is backed up by a rotatable backup roll and which is provided with at least one cavity for receiving the perforating knife.

BEST MODE OF CARRYING OUT THE INVENTION

Figure 1:
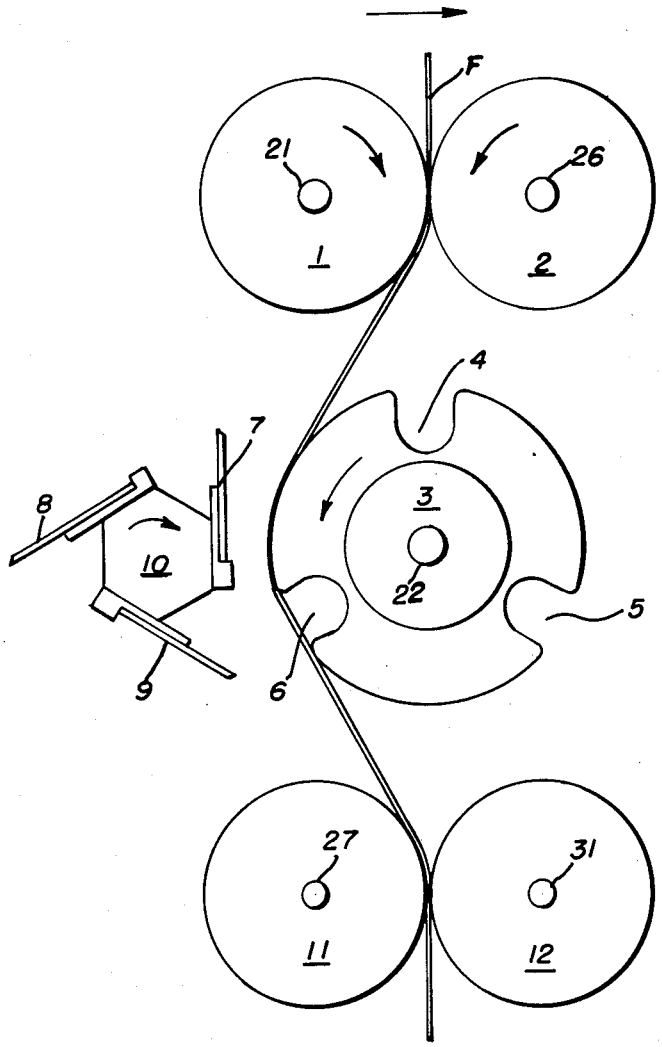
FIG. 1 is an overall schematic view of a web perforating mechanism formed according to this invention.

With reference to FIG. 1, infeed rolls 1 and 2 receive the web of film F therebetween and supply that film alongside a rotatable backup roll 3 having cavities 4, 5 and 6 formed about its periphery for receiving perforating knives 7, 8 and 9 which are mounted on rotatable mandrel 10. Outfeed rolls 11 and 12 operate at a slightly greater velocity than the infeed rolls 1 and 2 so as to maintain the film F under slight tension in the region between the infeed and outfeed rolls and during perforating operations in which the knives such as 7, 8 and 9 pierce the film and enter the cavities such as 4, 5, and 6 respectively. For securely gripping the film, infeed roll such as 1 is formed of steel having a knurled surface while infeed roll 2 is formed of rubber coated steel. In like fashion outfeed roll 11 is formed of steel whose outer surface is knurled while outfeed roll 12 is formed of rubber covered steel.

Figure 1A:
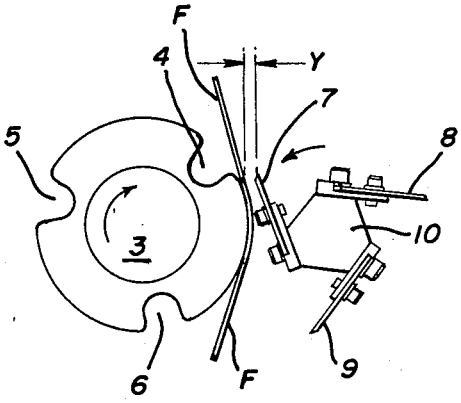
FIGS. 1*a*–1*f* are schematic representations of a portion of the perforating mechanism shown in FIG. 1 and which depict several stages of a web perforating operation.
Figure 1B:
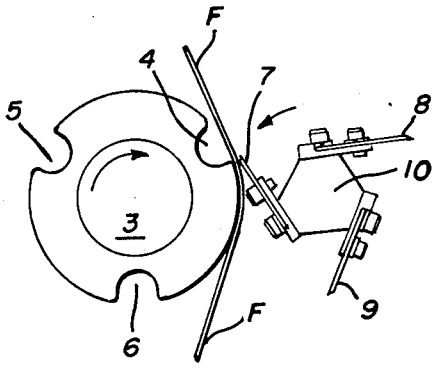
Figure 1C:
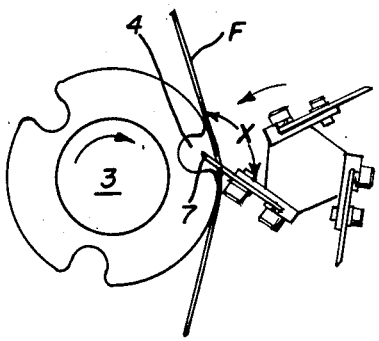
Figure 1D:
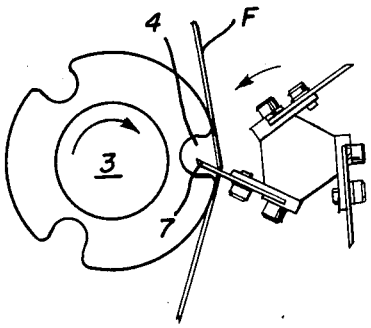

The stages through which a perforation is formed in film F are represented by FIGS. 1*a*–1*f*. FIG. 1*a* shows the perforating knife such as 7 approaching the film F while FIG. 1*b* shows the knife in its position of initial contact with the film F. FIGS. 1*c* and 1*d* depict two stages of a perforating operation during which the knife 7 perforates the film F and enters the cavity 4. Since the outfeed rolls 11 and 12 operate at a slightly greater speed (approximately 3%) than do the infeed rolls 1 and 2, the film F is under tension during the perforating operation as represented in FIGS. 1*a*–1*f* inclusive. The perforating operation is efficiently performed due to the fact that the body of each of the knives such as 7 is disposed at an obtuse angle to the infeed end of the film F as represented at X in FIG. 1*c*. In effect the tension of the film simply effects rupture by pulling the web against the adjacent knife such as 7.

Figure 1E:
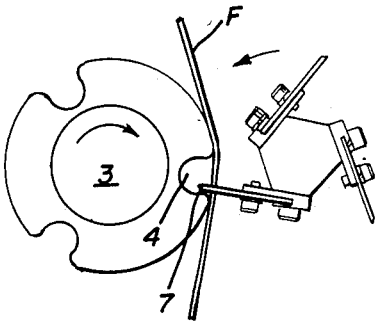
Figure 1F:
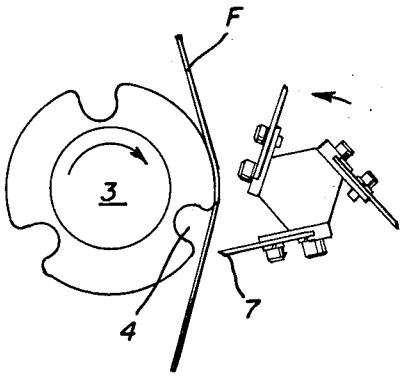

Following completion of a perforating operation, the knife such as 7 is withdrawn as is represented by FIGS. 1*e* and 1*f*.

Backup roll 3, mandrel 10, knives 7, 8, 9 can be rotated continuously or via intermittent drive such as a geneva drive or cam operated indexer. Continuous rotation limits the cutter to a specific repeat length and generally requires physically larger components. Specifically a knife assembly and back up roll 8" diameter is measured at the knife tip for a 27" repeat vs. 3½" diameter when using an indexer.

Figure 5:
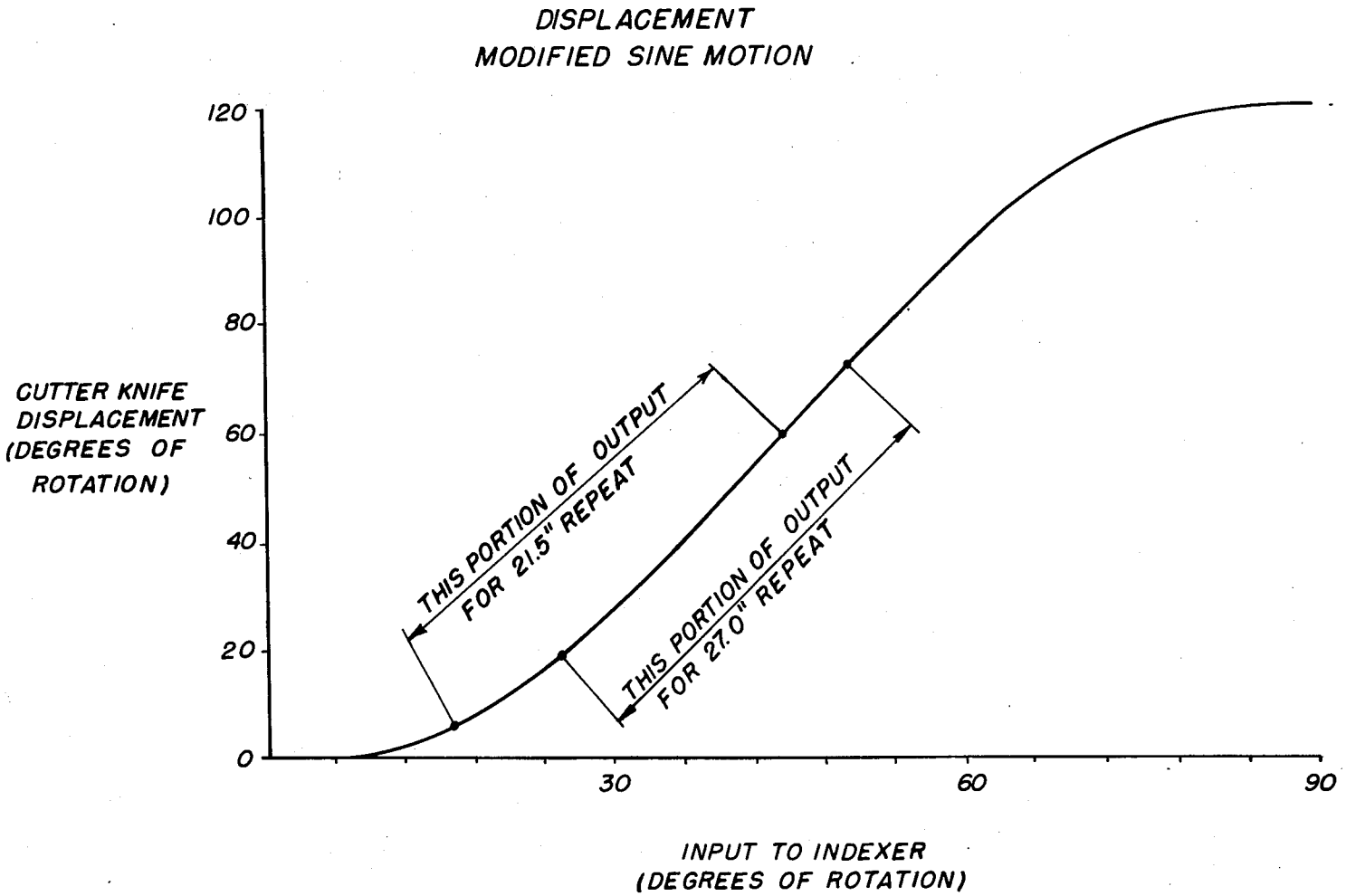
FIG. 5 is a graphic showing of how changes in the initial dwell position of the knife allow utilization of different portions of an indexer output to accommodate changes in repeat length.

The backup roll 3, mandrel 10, and associated knives 7, 8, 9 preferably are rotated by a cam operated indexer. Typical commercially avialable indexers utilize a modified sine acceleration curve. Use of the indexer permits one to select a portion of the output as shown in FIG. 5 so as to approximate the correct cutting velocity for different repeat lengths of film. For example, the same knife and backup roll configuration can be utilized for repeat lengths of 21.5" to 27.0" simply by changing the initial dwell position of the knife, dimension "Y" in FIG. 1*a*.

Figure 2A:
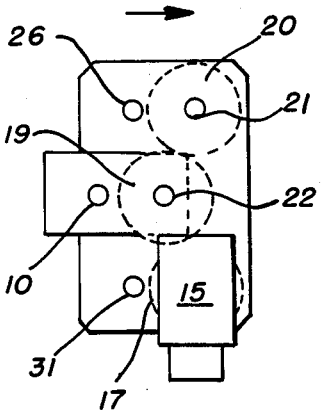
FIG. 2*a* is a side view of the apparatus shown in FIG. 2 as viewed from the right hand end of FIG. 2.
Figure 2B:
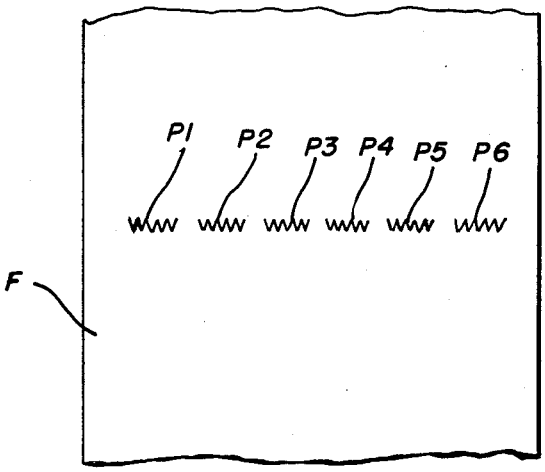
FIG. 2*b* is a representation of a fragment of shrink film showing perforations formed therein by the apparatus of the invention.

While the views designated FIGS. 1*a*–1*e* inclusive show single knives such as 7, 8 and 9, it will be understood each knife preferably constitutes a row of several knives such as six so that six perforations are formed transversely of the web as indicated in FIG. 2*b* and designated P1, P2, P3, P4, P5 and P6. These perforations receive projecting parts of an operating machine element which in turn manipulates the wrapper in such a manner as to secure it about the axis of a group of articles being wrapped which is transverse to the direction of movement of the article group.

Figure 2:
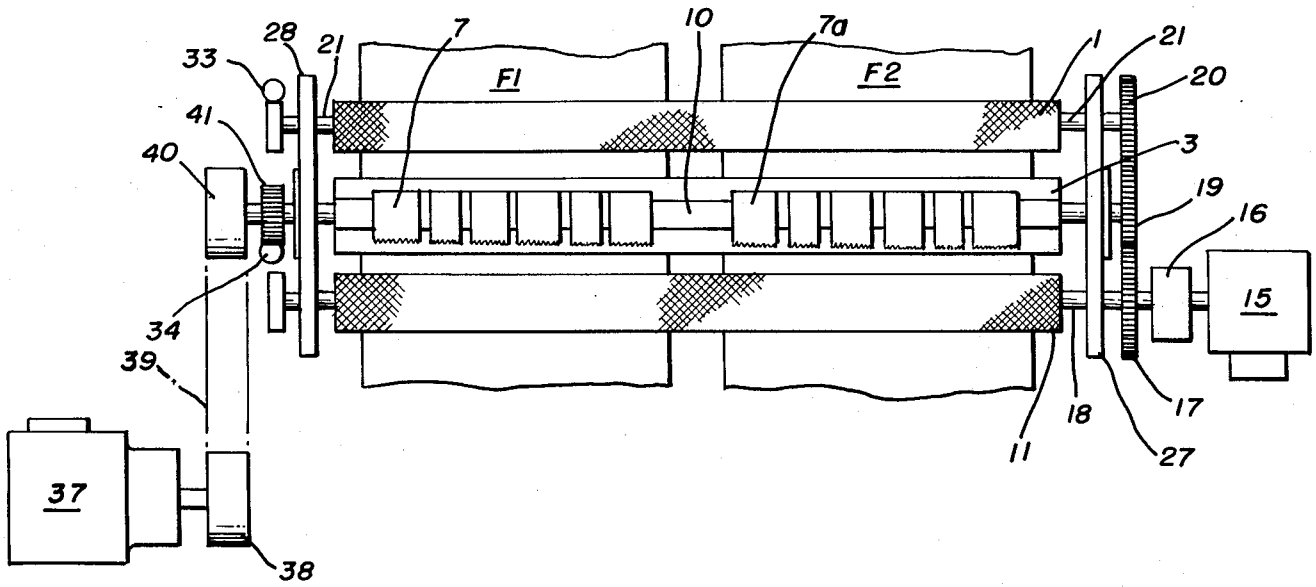
FIG. 2 is a view of apparatus formed according to this invention as viewed from the infeed end.
Figure 3:
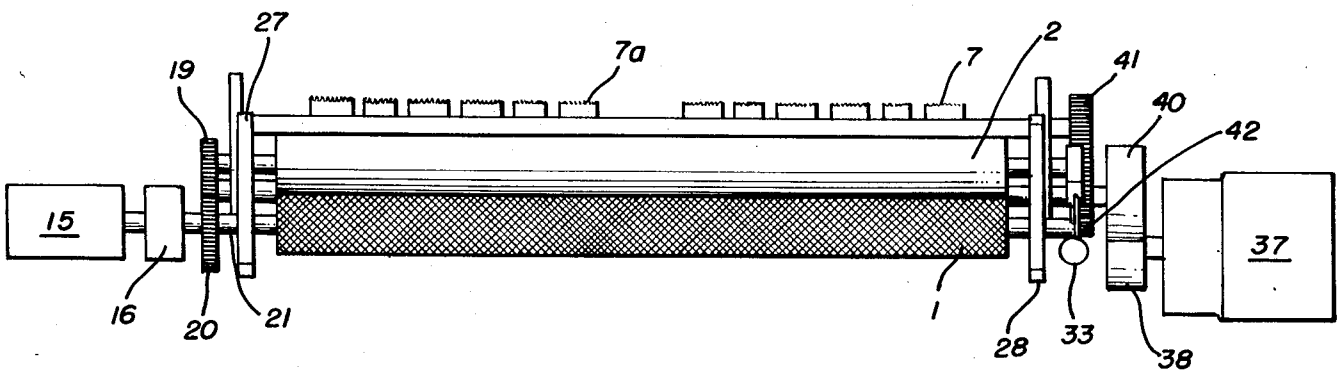
FIG. 3 is a view similar to FIG. 2 and shows the apparatus as viewed from above.
Figure 4A:
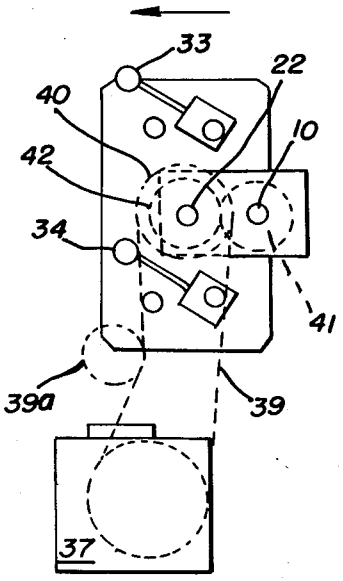
FIG. 4*a* is an end view of the apparatus shown in FIG. 4 as seen from the right hand end of that figure.
Figure 4:
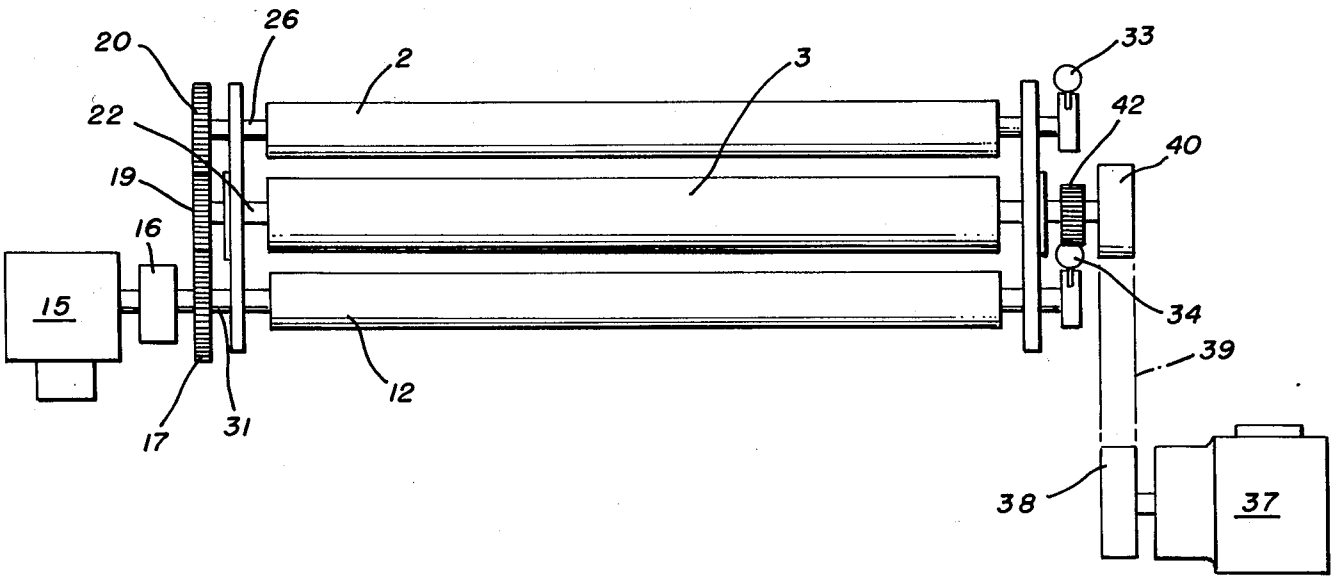
FIG. 4 is a view similar to FIG. 3 and shows the apparatus as viewed from the outfeed end.

As shown in FIG. 2, the apparatus may be arranged so as to perforate two webs such as are indicated at F1 and F2. The mechanism is driven by motive means such as variable speed device 15 having a driven device 16 arranged to drive gear 17 mounted on shaft 18 of bottom outfeed roll 11. Rotation of gear 17 imparts rotation to gears 19 and 20. Gear 20 is securely affixed to the shaft 21 of the knurled infeed roll 1. Gear 19 idles on shaft 22.

Roller 2 is supported on bearings mounted on fixed shaft 26 and frictionally engages roller 1 which drives roller 2. Shaft 26 is supported by frame elements 27 and 28. Roller 12 is mounted in bearings on fixed shaft 31 and frictionally engages roller 11. Shaft 31 is supported by frame elements 27 and 28.

Devices 33–34 provide for unlocking the feed rolls so as to allow the film to be fed between the infeed and outfeed rolls initially at start up. Device 33 is mounted on shaft 22 which is eccentrically mounted in frame elements 27 and 28. Device 34 is mounted on shaft 31 which is eccentrically mounted in frame elements 27 and 28.

The variable speed device 15 is conventional and controls the velocity of the infeed and outfeed rolls and may be used to change the speed of these elements to accommodate different print copy spacings on the webs F1 and F2.

For operating the mandrel 10 so as to cause that device to index, the conventional indexing device 37 is provided and is arranged so as to cause the mandrel 10 to rotate through increments of angular rotation interspersed with dwell periods by virtue of a suitable connection such as roller chain 39.

The indexing operation of mandrel 10 may be adjusted in known manner so as to be at rest as represented in FIG. 1*a* while the web is moving at a constant speed. The knife then rotates and intersects the web at the position represented in FIG. 1*b*. At this position the web is traveling slightly faster than the knife so that the outfeed rolls pull the web on to the knife as represented in FIGS. 1*c* and 1*d*. Thereafter movement of the knife such as 7 accelerates and moves more rapidly than does the web as is represented in FIGS. 1*e* and 1*f*.

Of course the mandrel 10 must operate in synchronism with operation of the back up roll 3.

Rotation of shaft 22 and of gear 42 rotates gear 41 and mandrel 10. Shaft 22 is coupled through sprocket 40 and chain 39 with indexer 37 which controls the movement and dwell periods of sprocket 40 which drives mandrel 10. Idler sprocket 39*a* cooperates with chain 39 in known manner.

INDUSTRIAL APPLICABILITY

This invention is especially applicable to mechanism which may be precisely controlled so as properly to perforate a continuously moving web such as may be formed of low density polyethylene film and which is adaptable to vary the spacing of the perforations along the length of the web as may be necessary to accommodate variations in print copy.

We claim:

1. Apparatus for perforating at spaced intervals a continuously moving flexible web said apparatus comprising means for moving and tensioning the web, a plurality of perforating knives mounted in peripherally spaced relation on a rotatable mandrel disposed adjacent the web and movable into perforating engagement therewith to impart perforations which are disposed in a transverse direction only to the direction of peripheral movement of the web, said perforating knives being disposed at an obtuse angle to the infeed end of the web and being movable at a peripheral velocity which is less than the linear velocity of the web during perforation thereof and being movable away from the web at a peripheral velocity somewhat greater than the linear velocity of the web following completion of a perforating operation, and means for controlling the velocity of rotation of said mandrel to provide variations in repeat lengths between perforations.

2. Apparatus according to claim 1 wherein a back up roll is arranged in contact with the side of the web which is opposite from said perforating knives for stabilizing the web against movement in a direction away from said knives during perforation thereof.

3. Apparatus according to claim 2 wherein said back up roll is rotatable.

4. Apparatus according to claim 2 wherein said back up roll includes a plurality of cavities for receiving a part of each of said perforating knives during and immediately following web perforating operations.

5. Apparatus according to claim 1 wherein a rotatable back up roll is disposed to engage the side of the web opposite from said mandrel and knives and wherein a plurality of cavities are formed in said back up roll for respectively receiving said perforating knives.

6. Apparatus according to claim 1 wherein rotation of said mandrel is indexed to afford incremental sequential movements interspersed with dwell periods and wherein the initial dwell positions of the knives are changeable to change repeat lengths between perforations.

7. Apparatus according to claim 1 wherein movement of the web is controlled by a pair of rotatable feed rolls disposed upstream of said perforating knives and by a pair of rotatable feed rolls disposed downstream of said perforating knives.

8. Apparatus according to claim 7 wherein said rolls which are downstream of said perforating knives are rotated at a velocity which is somewhat greater than the velocity of rotation of the rolls which are upstream of said perforating knives for maintaining the web under tension during perforation thereof.

9. Apparatus according to claim 7 wherein the velocity of rotation of said feed rolls disposed upstream and downstream of said perforating knives is controllable for varying the spacing between perforations along the length of the web.

* * * * *